US008115370B2

(12) United States Patent
Huang

(10) Patent No.: US 8,115,370 B2
(45) Date of Patent: Feb. 14, 2012

(54) BENDING LED BULB

(75) Inventor: David Huang, Taipei (TW)

(73) Assignee: Liquidleds Lighting Corp., Taipei (TW)

( * ) Notice: Subject to any disclaimer, the term of this patent is extended or adjusted under 35 U.S.C. 154(b) by 0 days.

(21) Appl. No.: 12/854,277

(22) Filed: Aug. 11, 2010

(65) Prior Publication Data

US 2011/0050073 A1 Mar. 3, 2011

(30) Foreign Application Priority Data

Sep. 2, 2009 (TW) ..... 98216183 U

(51) Int. Cl.
*H01J 5/02* (2006.01)
*H01J 61/52* (2006.01)

(52) U.S. Cl. ..... 313/46; 313/512; 313/634; 313/317; 362/800; 362/294; 362/373; 362/218

(58) Field of Classification Search ..... None
See application file for complete search history.

(56) References Cited

U.S. PATENT DOCUMENTS

| | | | | |
|---|---|---|---|---|
| 4,439,818 | A * | 3/1984 | Scheib | 362/249.06 |
| 6,082,867 | A * | 7/2000 | Chien | 362/84 |
| 6,371,637 | B1 * | 4/2002 | Atchinson et al. | 362/555 |
| 2005/0162850 | A1 * | 7/2005 | Luk et al. | 362/227 |
| 2007/0153517 | A1 * | 7/2007 | Sloan et al. | 362/240 |
| 2007/0291473 | A1 * | 12/2007 | Traynor | 362/106 |
| 2010/0048097 | A1 * | 2/2010 | Ma | 446/473 |
| 2010/0253221 | A1 * | 10/2010 | Chiang | 315/32 |
| 2011/0019370 | A1 * | 1/2011 | Koh | 361/749 |

* cited by examiner

*Primary Examiner* — Ashok Patel
(74) *Attorney, Agent, or Firm* — C. G. Mersereau; Nikolai & Mersereau, P.A.

(57) ABSTRACT

A bending LED bulb has a transparent bending tube and a flexible LED strip. The flexible LED strip has a flexible printed circuit board (PCB) and a plurality of LEDs mounted on the flexible PCB and is inserted and fixed in the transparent bending tube. As the LEDs are sequentially mounted on the flexible PCB, the LEDs are adjacent to a wall of the transparent bending tube, and are equally spaced. Accordingly, a lumen value of the bending LED bulb can be raised, and heat generated by the LEDs can be dissipated out through the wall of the transparent bending tube to avoid high temperature arising from accumulation of the waste heat.

14 Claims, 11 Drawing Sheets

BENDING LED BULB

BACKGROUND OF THE INVENTION

1. Field of the Invention

The present invention is related to an LED bulb, and more particularly to a bending LED bulb that can provide uniform luminance and dissipate out heat generated by LEDs.

2. Description of the Related Art

Ball-type bulbs and incandescent tubes for lighting purpose in early stage are all quite common.

In view of the awakening energy-saving consciousness, energy-saving bulbs, such as U-shaped bulb, 2C type bulb and helical bulb, have started their entry in the light market. In spite of being more energy-saving, LED bulbs with more energy-saving capability overwhelm the glamour of the earlier energy-saving bulbs to become the new favorite in the market after high power white light LED technique become mature.

With reference to FIGS. 13 and 14, a conventional LED ball-type bulb 30 has a base 31, an LED substrate 32 and a glass cover 33.

The base 31 has a free end, a base electrode 311 and a bottom electrode 312. The base electrode 311 takes a form of threads formed around the base 31 for screwing into a screw lamp socket. The bottom electrode 312 is formed on a bottom of the base 31.

The LED substrate 32 is securely mounted on an end of the base 31 opposite to the free end, and has a rigid circuit board 321, a plurality of light-emitting diodes (LED) 322 and a heat sink 323. The rigid circuit board 321 is electrically connected to the base electrode 311 and the bottom electrode 312. The LEDs 322 are mounted on a top of the rigid circuit board 321 in a form of a matrix pattern. The heat sink is mounted on a bottom of the rigid circuit board 321. The glass cover 33 is securely mounted on the base 31 to cover the LED substrate 32 therein.

As the candle (cd) of a bulb for lighting must reach a standard value, the LED bulb 30 needs to employ a plurality of LEDs, for example, as shown in FIG. 14, to meet that end. LED is well-known in consuming less power, yet a layout of the LEDs 322 ends up with a shorter life duration of the LED bulb 30 because of heat generated from the LEDs 322. After a long term of operation, the accumulated heat escalate the temperature of the overall LED bulb 30. In particular, the LEDs 322 that centrally located have a higher temperature than that of other LEDs 322 and are prone to damage. Hence, LED bulbs or tubes with similar LED layout have to be arranged with additional heat dissipation structure and this increases the cost for manufacturing the LED bulb 30.

Furthermore, there are plenty of ball-type LED bulbs and LEDs tubes currently available in the marketplace, while energy-saving bending LED tubes haven't been absent in the market so far. If the heat dissipation issue of the LEDs can be solved, LED bulbs can be further promoted as the new-generation energy-saving lighting source.

SUMMARY OF THE INVENTION

An objective of the present invention is to provide a bending LED bulb providing uniform luminance and dissipating waste heat generated by LEDs.

To achieve the foregoing objective, the bending LED bulb has a transparent bending tube and at least one flexible LED strip. The transparent bending tube has two ends and at least one sealing end. The at least one sealing end is formed on at least one of the ends of the transparent bending tube. Each one of the at least one sealing end has a power electrode mounted thereon.

The at least one flexible LED strip is mounted in the transparent bending tube and each one of the at least one flexible LED strip has a flexible PCB and a plurality of LEDs. The flexible PCB is electrically connected with the at least one power electrode. The plurality of LEDs is separately mounted on the flexible PCB.

The flexible LED strip has the LEDs mounted thereon passes through the transparent bending tube with various shapes to form the bending LED tube. As the LEDs are separately mounted on the transparent bending tube, the LEDs can be uniformly allocated in the transparent bending tube. Moreover, because the LEDs are adjacent to the wall of the transparent bending tube 10, not only can luminance of the bending LED bulb be enhanced, but also waste heat generated by the LEDs 22 can be dissipated out through the wall of the transparent bending tube 10, so as to avoid high temperature resulting from accumulation of the waste heat.

DETAILED DESCRIPTION OF THE INVENTION

Figure 1:
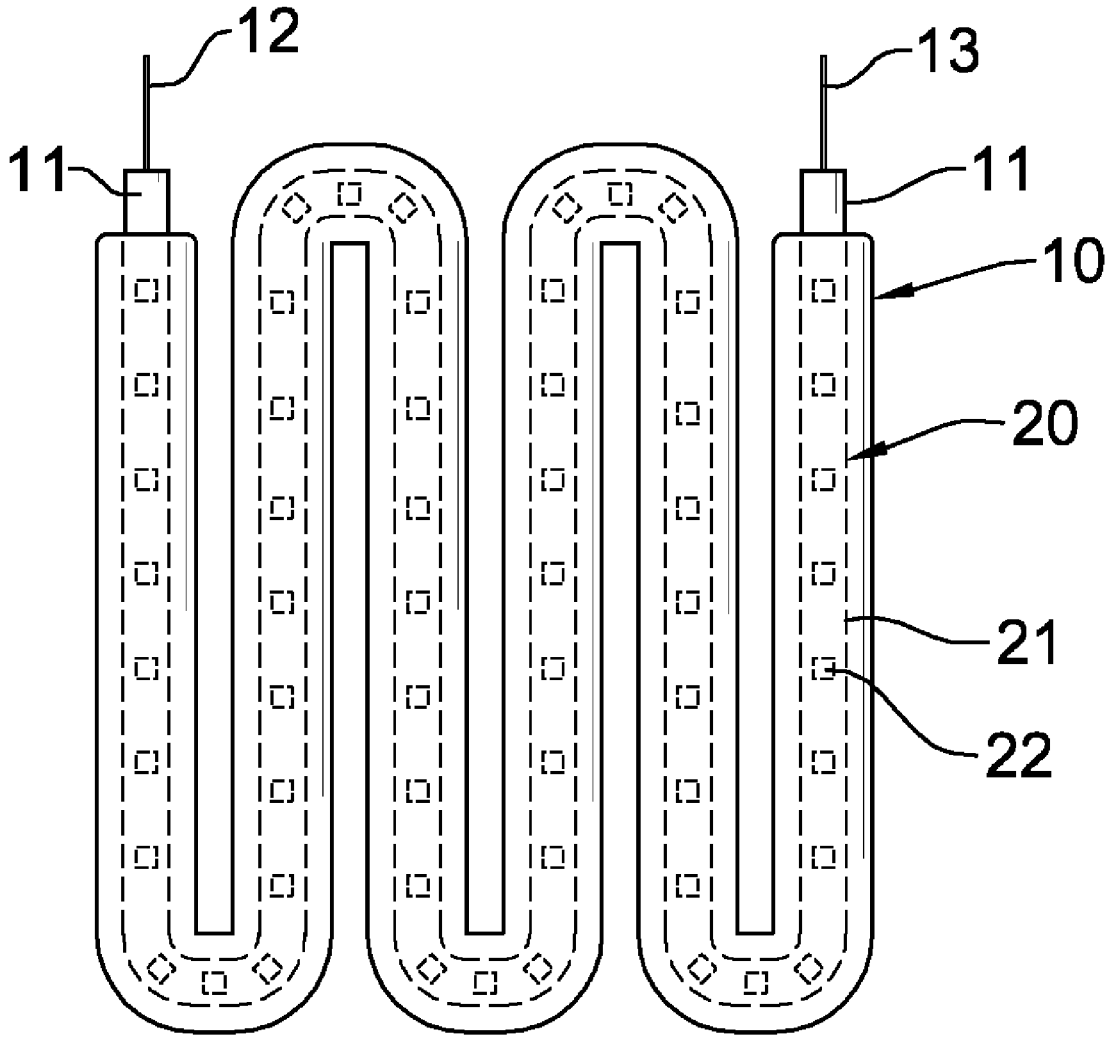
FIG. 1 is a front view of a first embodiment of a bending LED bulb in accordance with the present invention.

With reference to FIG. 1, a first embodiment of a bending LED bulb has a transparent bending tube 10 and at least one flexible LED strip 20.

The transparent bending tube 10 has two sealing ends 11 and two power electrodes 12, 13. The two sealing ends 11 are respectively formed on two ends of the transparent bending tube 10. The two power electrodes 12, 13 are respectively mounted on the two sealing ends 11. In the present embodiment, the transparent bending tube 10 is alternatively and repeatedly bent up and down to have the two sealing ends facing a same direction.

The at least one flexible LED strip 20 is received in the transparent bending tube 10, and has a flexible printed circuit board (PCB) 21 and a plurality of LEDs 22. The LEDs 22 are separately mounted on the flexible PCB 21. Both ends of the flexible PCB 21 are electrically and respectively connected with the two power electrodes 12, 13 on the two ends of the transparent bending tube 10. In an embodiment, the LEDs 22 are spaced on the flexible PCB 21 at equal intervals. Alternatively, the LEDs 22 may be spaced on the flexible PCB 21 at different intervals.

Figure 2:
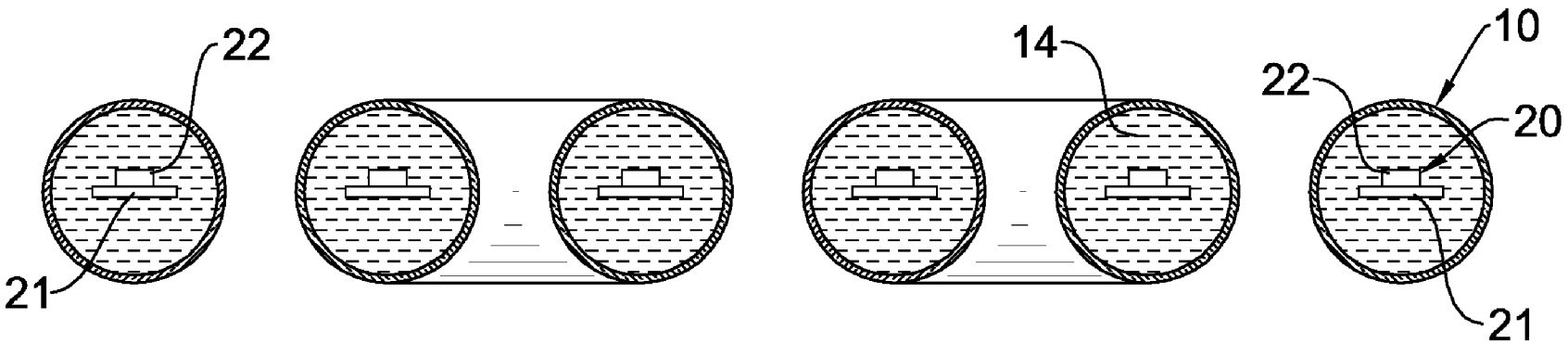
FIG. 2 is an enlarged side view in partial section of the bending LED bulb in FIG. 1.

With reference to FIG. 2, as illustrated, the LEDs 22 are dispersed inside the transparent bending tube 10, and each LED 22 is quite close to a wall of the transparent bending tube 10 and keeps distances apart from the adjacent LEDs 22. Accordingly, the luminance of the bending LED bulb can be raised, and the heat generated by the LEDs 22 can be efficiently dissipated out to avoid accumulation of the heat. Therefore, high temperature arising from lengthy lighting duration can be effectively improved, and an additional heat sink is not necessary.

Figure 3:
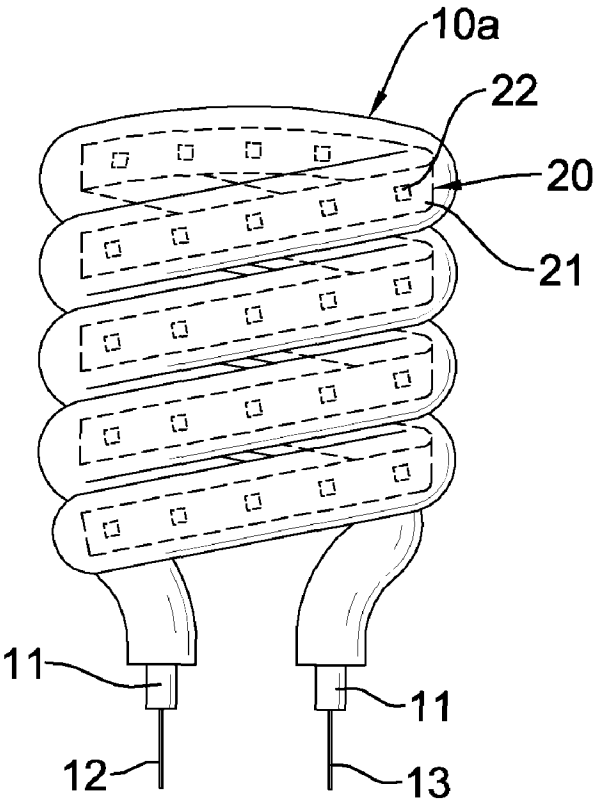
FIG. 3 is a front view of a second embodiment of a bending LED bulb in accordance with the present invention.

With reference to FIG. 3, in the second embodiment of the bending LED bulb, the transparent bending tube 10*a* is helically wounded to take a form of a circular helix. The flexible LED strip 20 is mounted in and extends throughout the transparent bending tube 10*a* and is bent according to a shape of the transparent bending tube 10*a* to disperse the plurality of LEDs 22 in the transparent bending tube 10*a*.

Figure 4:
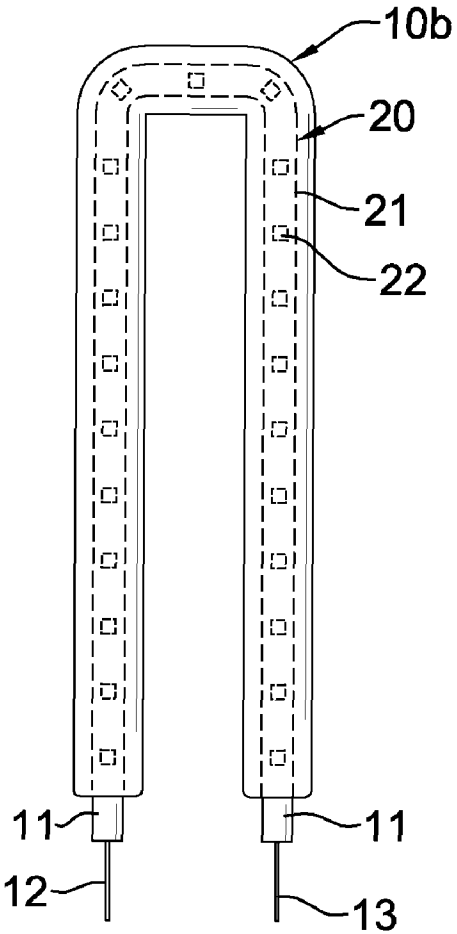
FIG. 4 is a front view of a third embodiment of a bending LED bulb in accordance with the present invention.

With reference to FIG. 4, in the third embodiment of the bending LED bulb, the transparent bending tube 10*b* is U-shaped. The flexible LED strip 20 is mounted in and extends throughout the transparent bending tube 10*b* and is bent according to a shape of the transparent bending tube 10*b* to disperse the plurality of LEDs 22 in the transparent bending tube 10*b*.

Figure 5:
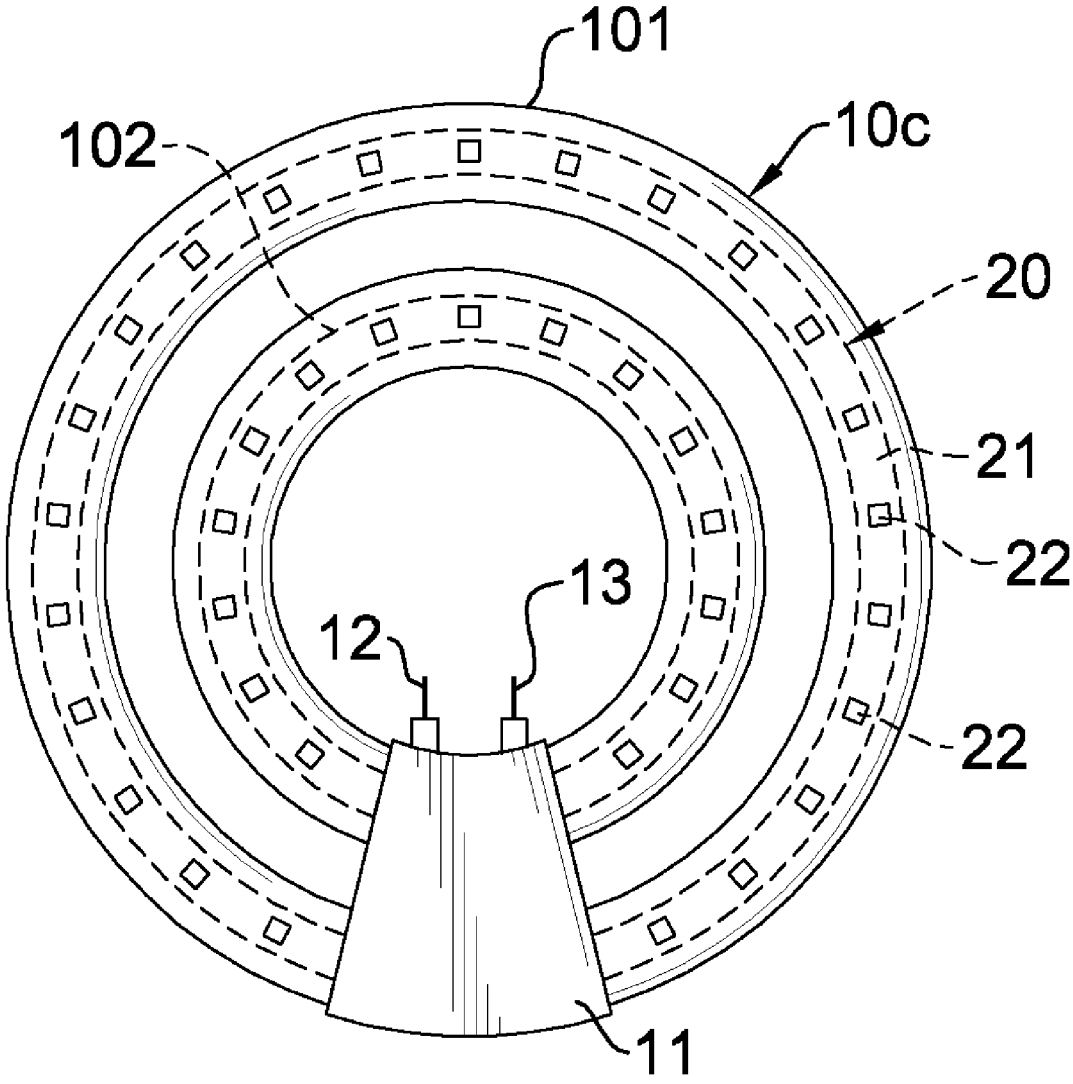
FIG. 5 is a front view of a fourth embodiment of a bending LED bulb in accordance with the present invention.

With reference to FIG. 5, in the fourth embodiment of the bending LED bulb, the transparent bending tube 10*c* is formed by a large C tube 101 and a small C tube 102 to take a form of a double C tube, in which the large C tube 101 is mounted around the small C tube 102 with openings of the two C tubes facing an identical direction. Two flexible LED strips 20 are respectively mounted in and extends throughout the large C tube 101 and the small C tube 102 and are bent according to shapes of the large C tube 101 and the small C tube 102 to disperse the plurality of LEDs 22 in the transparent bending tube 10*b*. The two sealing ends 11 are integrally formed and are securely connected with the two ends of each of the large C tube 101 and the small C tube 102. The two electrodes 12, 13 are mounted on the integrally formed sealing ends 11.

Figure 6:
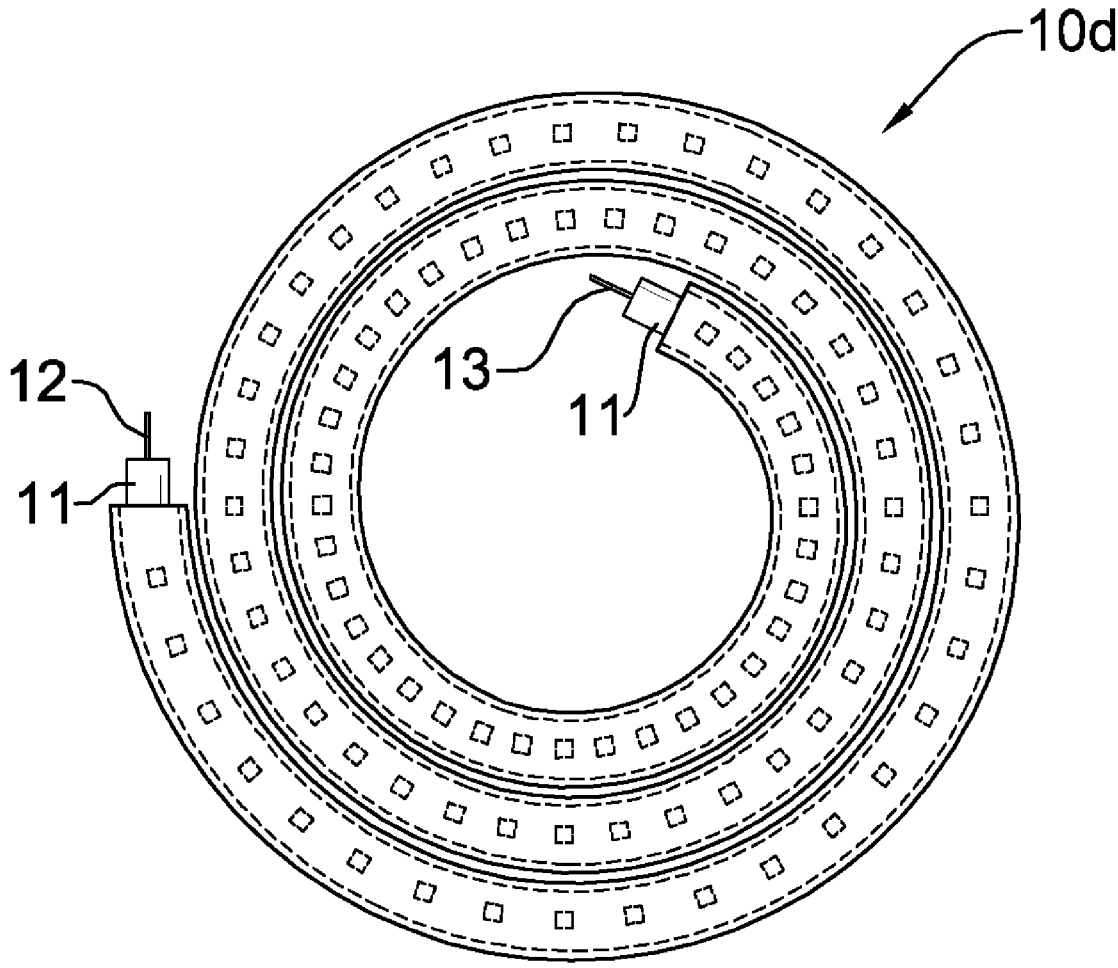
FIG. 6 is a front view of a fifth embodiment of a bending LED bulb in accordance with the present invention.

With reference to FIG. 6, in the fifth embodiment of the bending LED bulb, the transparent bending tube 10*d* is spirally wounded. The flexible LED strip 20 is mounted in and extends throughout the transparent bending tube 10*d* and is bent according to a shape of the transparent bending tube 10*d* to disperse the plurality of LEDs 22 in the transparent bending tube 10*d*.

Figure 7:
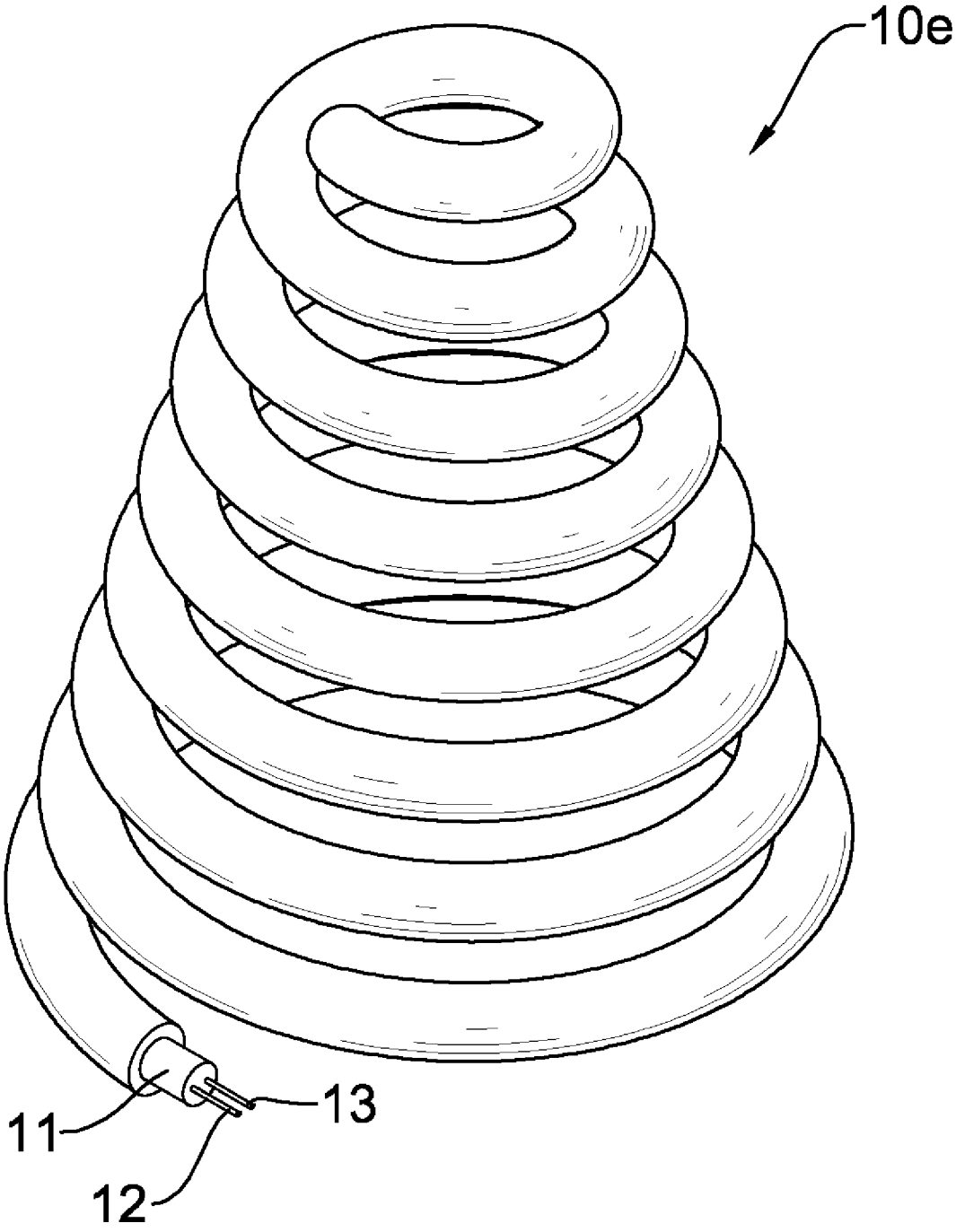
FIG. 7 is a perspective view of a sixth embodiment of a bending LED bulb in accordance with the present invention.

With reference to FIG. 7, in the sixth embodiment of the bending LED bulb, the transparent bending tube 10*e* is helically wounded to take a form of a conic helix. One flexible LED strip 20 is mounted in and extends throughout the transparent bending tube 10*e* and is bent according to a shape of the transparent bending tube 10*e* to disperse the plurality of LEDs 22 in the transparent bending tube 10*e*.

Figure 8:
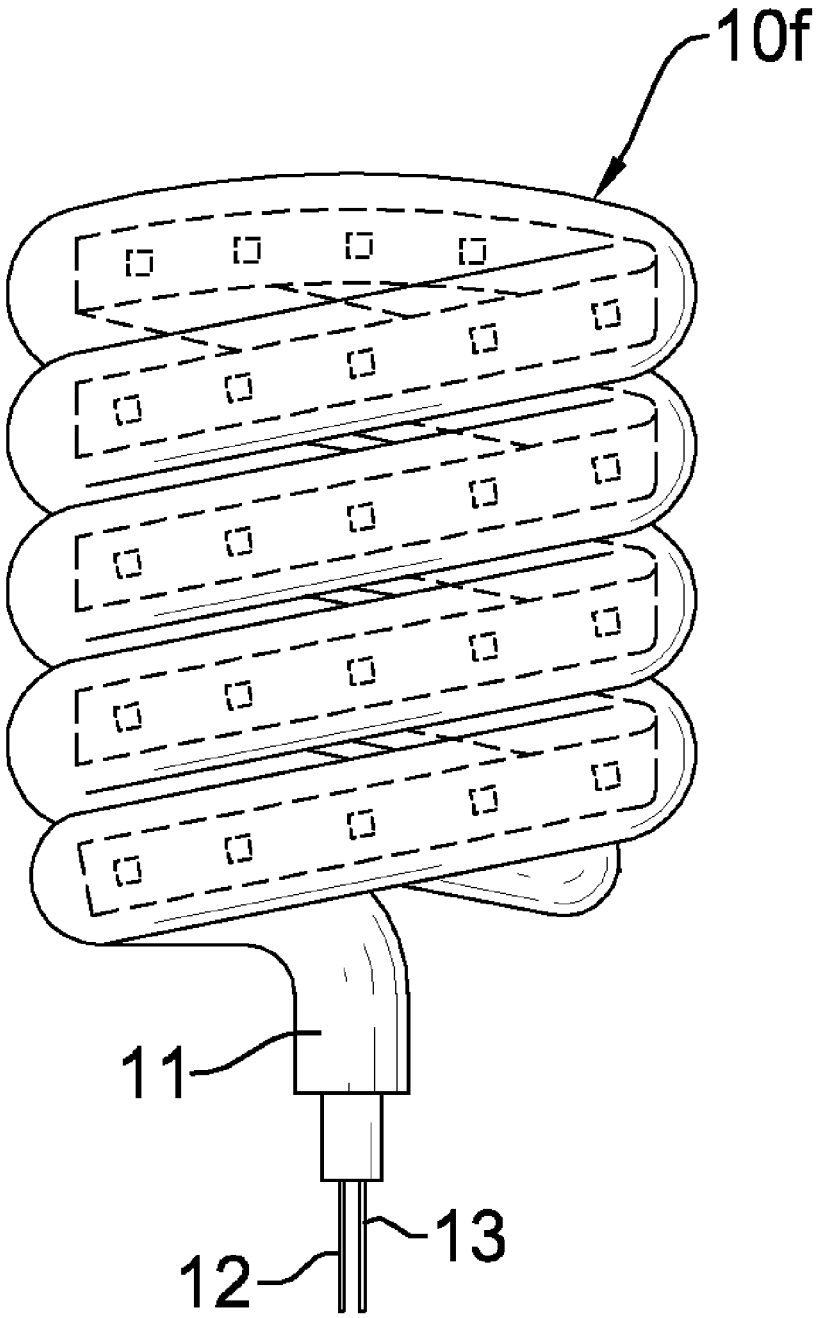
FIG. 8 is a front view of a seventh embodiment of a bending LED bulb in accordance with the present invention.

As illustrated by the foregoing embodiments, the transparent bending tube 10~10*e* has at least one sealing end 11. As shown in FIGS. 1, 3, 4, 6, two sealing ends 11 are mounted on the two ends of the transparent bending tube 10, 10*a*, 10*b*, 10*d*. As shown in FIGS. 5, 7, 8, the transparent bending tube 10*c*, 110*e*, 10*f* has only one sealing end 11 having the power electrodes 12, 13 mounted therein. Other forms of the transparent bending tube are possible and fall within the scope of the present invention.

Figure 9:
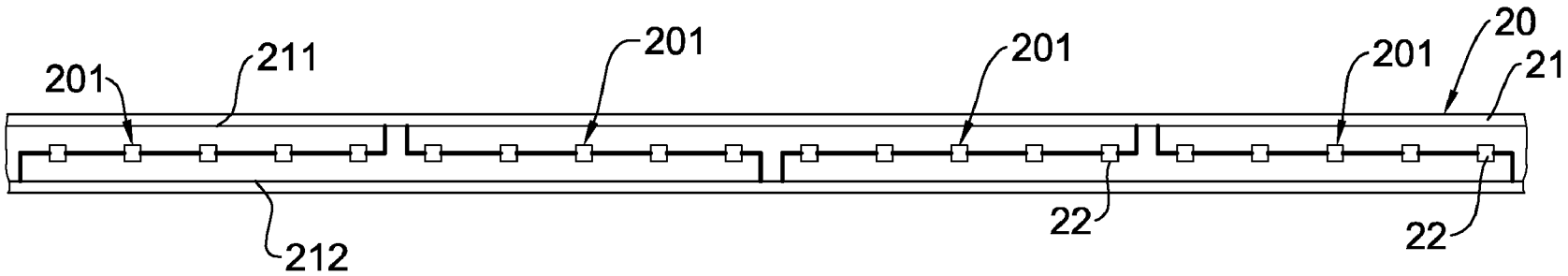
FIG. 9 is a front view showing a detailed structure of a flexible LED strip in accordance with the present invention.
Figure 10:
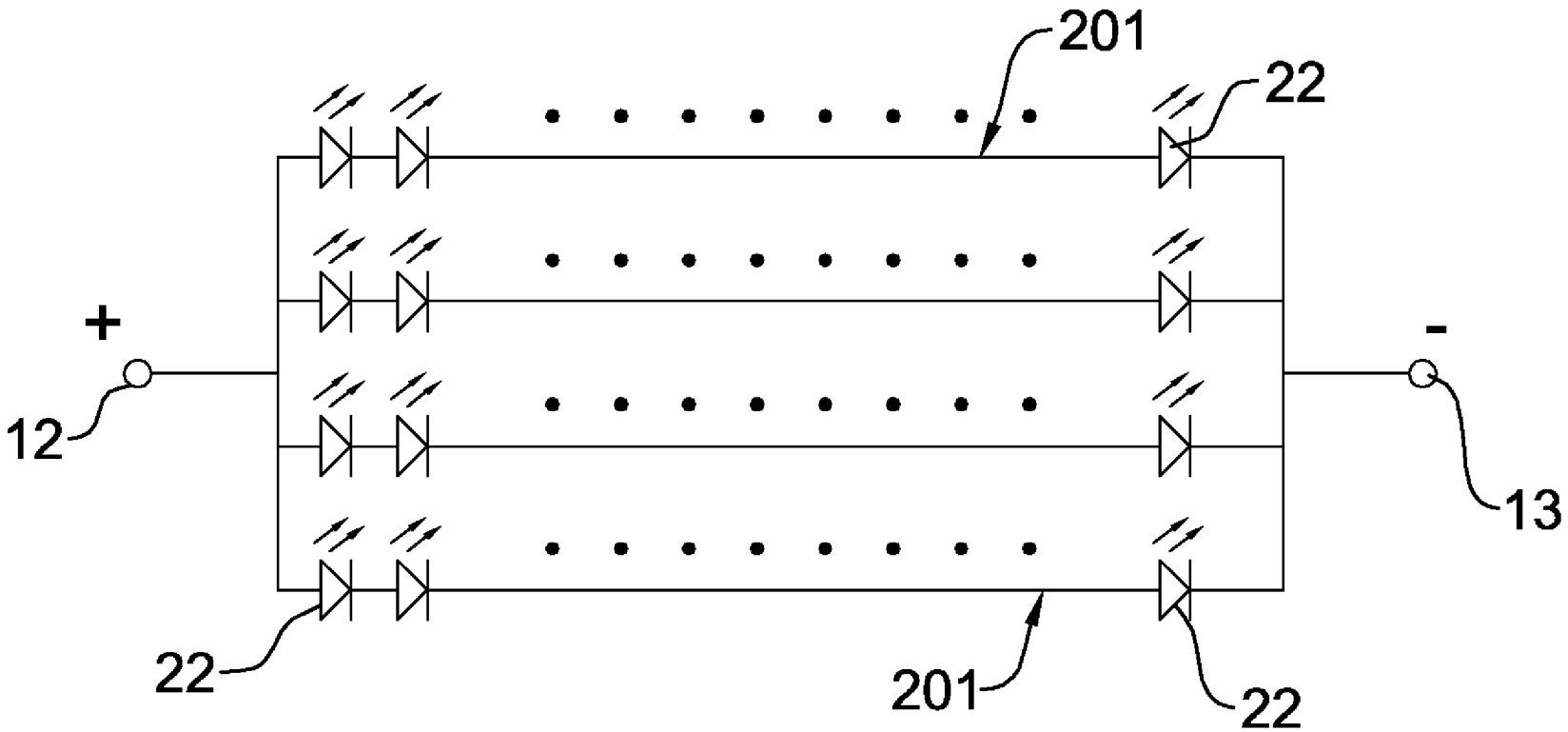
FIG. 10 is a circuit diagram of FIG. 9.

With reference to FIG. 9, the flexible LED strip 21 has two metal wires 211, 212 formed thereon. The two metal wires 211, 212 are electrically and respectively connected with the power electrodes 12, 13 of the transparent bending tube 10. The LEDs 22 are soldered respectively on the two metal wires 211, 212. When the power electrodes 12, 13 are electrically connected with a power source, the LEDs 22 can be lit. To enhance lighting efficiency, the plurality of LEDs 22 of the flexible LED strip 20 can be classified into several sub light groups 201, for example, five LEDs 22 serially connected as a sub light group 201. Multiple sub light groups 201 are parallelly connected and then are connected respectively with the two metal wires 211, 212 to form a equivalent circuit diagram as shown in FIG. 10. As mentioned earlier in an embodiment, the LEDs 22 are equally spaced on the flexible LED strip 20. The distance between LEDs is preferably adjusted by a consumed wattage of an LED 22. Specifically, the distance is proportional to the consumed wattage. It is comprehensible that the LEDs 22 spaced by different distance therebetween also fall within the scope of the present invention.

Besides, a total voltage consumed by the flexible LED strip 20 or all LEDs 22 of each sub light group 201 is equal to an input voltage of an external power source. For example, in an embodiment, if a driving voltage $V_f$ required by an individual LED is 3.3 V and an external input voltage is 120 V, a total voltage of all the LEDs 22 serially connected in each sub light group 201 is a multiple of 3.3 V and the total voltage shall be substantially equal to the external input voltage. A plurality of sub light groups 201 can be further parallelly connected to the external input voltage or power.

To further enhance a cooling efficiency of the transparent bending tube 10~10*f*, the transparent bending tube 10~10*f* can be vacuumed and then filled in with a gas having a heat transfer coefficient higher than that of air or inert gas to prevent high temperature from oxidizing metal wires 211, 212 or metal contacts. The vacuuming and the filling of the gas or inert gas with higher heat transfer coefficient can be carried out through the sealing end 11 of the transparent bending tube 10~10*f* and with a duct of an external gas vacuum and a filling device. The sealing end 11 of the transparent bending tube 10~10*f* can be formed by directly melting at least one opening of the transparent bending tube 10~10*f*, thereby saving additional material. The sealing end 11 that receives the power electrodes 12, 13 therein further has a non-conductive portion, such as a rubber plug or a ceramic plug, to seal at least one end of the transparent bending tube 10~10*f* by tight fitting, press fitting or adhesive bonding. Moreover, the transparent bending tube 10~10*f* of the present invention is preferably made of a glass material. Any other material or compound material (for example, silicon and the like) similar to glass also falls within the scope of the present invention.

With further reference to FIG. 2, to further enhance the cooling efficiency of the transparent bending tube 10~10*f*, a liquid 14 represented by the dash lines can be filled in the transparent bending tube 10 after the transparent bending tube 10~10*f* is vacuumed. The vacuuming and the filling of the liquid 14 can be carried out through the sealing end 11 of the transparent bending tube 10~10*f* and with a duct of an external gas vacuum and a filling device.

Figure 12:
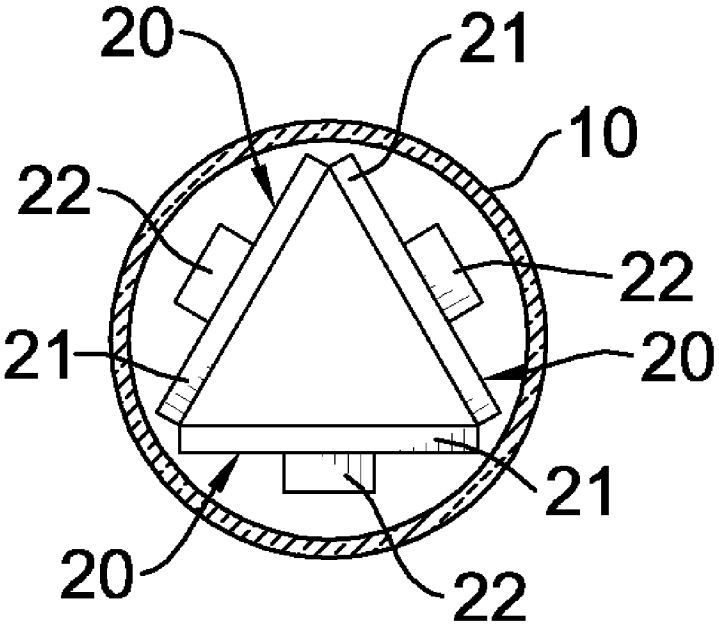
FIG. 12 is a side view in partial section of a second embodiment of the flexible LED strip in accordance with the present invention.
Figure 11:
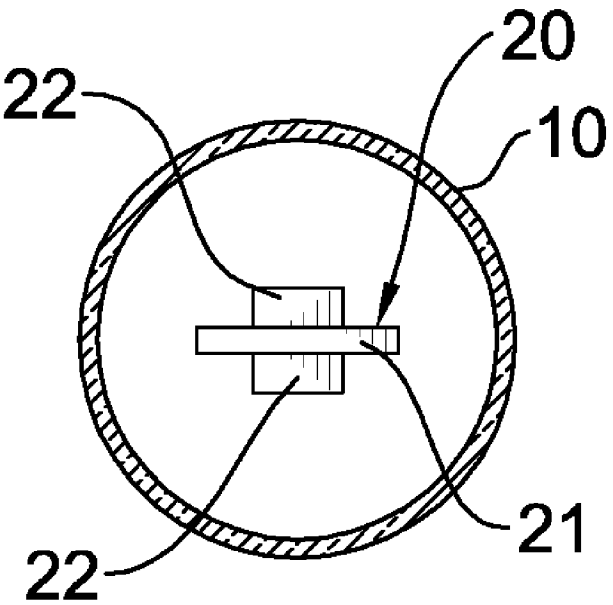
FIG. 11 is a side view in partial section of a first embodiment of the flexible LED strip in accordance with the present invention.
Figure 13:
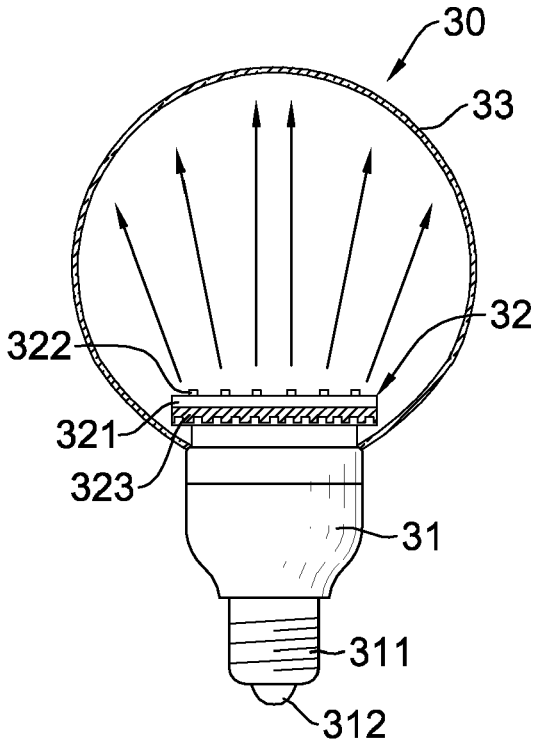
FIG. 13 PRIOR ART
FIG. 13 is a front view in partial section of a conventional ball-type LED bulb.
Figure 14:
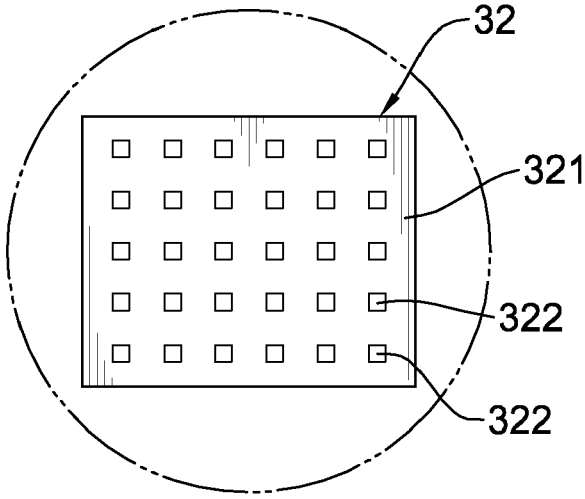
FIG. 14 PRIOR ART
FIG. 14 is a top view of the conventional ball-type LED bulb in FIG. 13.

With reference to FIG. 11, to raise lumen value of the bending LED bulb, the LEDs 22 are mounted respectively on two opposite sides of the flexible PCB 21 of the flexible LED strip 20. The resulting lumen value and uniformity of exit light can be effectively improved. With reference to FIG. 12, each transparent bending tube 10 has three flexible LED strips 20 mounted therein in a form of a triangular column so that the LEDs 22 can be positioned closely to the tube wall of the transparent bending tube 10 and the light exiting directions of the LEDs 22 are respectively separated one another by 120° apart. Therefore, the overall lumen value and the uniformity of exit light can be provided accordingly.

As known from the foregoing description, the flexible LED strip 20 having the LEDs 22 mounted thereon is mounted in and extends throughout the transparent bending tube 10 with various shapes to form the bending LED tube of the present invention. If the LEDs 22 are sequentially mounted on the transparent bending tube 10 at an equal interval, the LEDs 22 can be uniformly allocated in the transparent bending tube 10. Moreover, because the LEDs 22 are adjacent to the wall of the transparent bending tube 10, lumen value can be raised and the heats generated by the LEDs 22 can be dissipated out through the wall of the transparent bending tube 10 to avoid high temperature resulting from accumulation of the heat.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A bending LED bulb comprising:

a transparent bending tube made of glass and having:

two ends; and at least one sealing end formed on at least one of the ends of the transparent bending tube, each one of the at least one sealing end having a power electrode mounted thereon; and at least one flexible LED strip mounted in the transparent bending tube and each one of the at least one flexible LED strip having:

a flexible PCB electrically connected with the at least one power electrode; and a plurality of LEDs separately mounted on the flexible PCB.

2. The bending LED bulb as claimed in claim 1, wherein the flexible PCB of each one of the at least one flexible LED strip has two metal wires formed thereon and electrically connected with the power electrode of each one of the at least one sealing end; and the LEDs of each one of the at least one flexible LED strip are classified into multiple sub light groups parallelly connected with the two metal wires of the flexible LED strip, and each sub light group has multiple LEDs serially connected.

3. The bending LED bulb as claimed in claim 1, wherein the LEDs of each one of the at least one flexible LED strip are mounted on two opposite sides of the flexible PCB of the flexible LED strip.

4. The bending LED bulb as claimed in claim 1, wherein three flexible LED strips are mounted inside the transparent bending tube in a form of a triangular column.

5. The bending LED bulb as claimed in claim 1, wherein the transparent bending tube has two sealing ends and is alternatively and repeatedly bent up and down to have the two sealing ends facing a same direction.

6. The bending LED bulb as claimed in claim 1, wherein the transparent bending tube is helically wounded to take a form of a circular helix.

7. The bending LED bulb as claimed in claim 1, wherein the transparent bending tube is U-shaped.

8. The bending LED bulb as claimed in claim 1, wherein the transparent bending tube is formed by a small C tube and a large C tube mounted around the small C tube with openings of the two C tubes facing an identical direction.

9. The bending LED bulb as claimed in claim 1, wherein the transparent bending tube is spirally wounded.

10. The bending LED bulb as claimed in claim 1, wherein the transparent bending tube is helically wounded to take a form of a conic helix.

11. The bending LED bulb as claimed in claim 1, wherein the transparent bending tube is filled with a gas having a heat transfer coefficient higher than that of air.

12. The bending LED bulb as claimed in claim 11, wherein the gas is an inert gas.

13. The bending LED bulb as claimed in claim 1, wherein the LEDs of each one of the at least one flexible LED strip are mounted on the flexible PCB of the flexible LED strip at an equal interval.

14. The bending LED bulb as claimed in claim 1, wherein the transparent bending tube is filled with a liquid.

* * * * *